US005206971A

United States Patent [19]

Schmelzer et al.

[11] Patent Number: 5,206,971

[45] Date of Patent: May 4, 1993

[54] APPARATUS AND METHOD FOR INCREASING THE EFFICIENCY OF A DOOR CLOSER BY REDUCING FRICTION THEREIN

[75] Inventors: Lynn A. Schmelzer; Thomas R. Lasier, both of Princeton, Ill.

[73] Assignee: Schlage Lock Company, San Francisco, Calif.

[21] Appl. No.: 806,200

[22] Filed: Dec. 13, 1991

[51] Int. Cl.[5] ..... E05F 3/04; E05F 3/22

[52] U.S. Cl. ..... 16/62; 16/58; 16/79

[58] Field of Search ..... 16/49, 62, 71, 79, 58

[56] References Cited

U.S. PATENT DOCUMENTS 4,763,385 8/1988 Furch et al. ..... 16/62

4,999,872 3/1991 Jentsch ..... 16/62

*Primary Examiner*—W. Donald Bray

*Attorney, Agent, or Firm*—Robert F. Palermo

[57] ABSTRACT

A door closer has a fluid conduit connecting the high pressure portion of the cylinder in front of the piston with a cavity between the surfaces of the cylinder wall and the piston. This cavity is located at the intermediate lateral surface of the piston at the back side of a gear rack formed on the piston. The variable lateral bias provided by the pressurized cavity counteracts separating forces between the gear rack and a gear pinion caused by the tapered teeth. This decreases friction between the piston and the cylinder and reduces wear throughout the closer mechanism.

11 Claims, 3 Drawing Sheets

APPARATUS AND METHOD FOR INCREASING THE EFFICIENCY OF A DOOR CLOSER BY REDUCING FRICTION THEREIN

BACKGROUND OF THE INVENTION

This invention relates generally to door closers and more particularly to devices and techniques for increasing the efficiency of a hydraulically modulated door closer by reducing friction between a hydraulic cylinder and its piston.

Typically, a hydraulically modulated door closer involves a piston moving reciprocably within a fluid containing cylinder in response to driving forces exerted upon it by a spring, a rack and pinion gear train, or compressed fluids. As the door is opened, the pinion is rotated by an arm connecting the door closer mechanism and the door and frame. Rotation of the pinion drives the rack on the piston causing it to move in the cylinder bore and to compress a powerful spring. When the door is released, the stored energy in the compressed spring urges the piston in the opposite direction. This causes the rack to drive the pinion which swings the arm and thereby closes the door.

In order that the strong spring force not slam the door, hydraulic fluid which is confined in the cylinder in front of the piston head is metered through variable orifices to permit the door to close at a controlled rate. This provides a shock absorber or dashpot type damping to the closing motion of the door.

In the operation of the door closer just described, friction forces act to decrease efficiency of the closer. These forces, in addition to causing premature wear of the closer mechanism, impede the door motion and can contribute to weaker closings. Some friction losses occur between the piston and the cylinder wall at the lateral piston surface behind the internal rack of the piston. This is because the tapered teeth of the rack and pinion create a separating force between the two members. This force distorts the piston wall slightly and displaces the piston slightly toward the cylinder wall thereby increasing frictional drag between the cylinder wall and the piston. This decreases the efficiency of operation of the closer and contributes to premature wear of the closer.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing, in a door closer which has a piston within a cylinder with a gear rack formed on the piston and a gear pinion engaging the gear rack, the gear pinion being fixed to a shaft whose axis is perpendicular to the piston and the gear rack, the improvement, in combination with the piston, the cylinder, the gear rack, and the gear pinion, including a mechanism for providing a variable biasing force to the gear rack in order to counteract a separating force between the gear rack and the gear pinion.

The foregoing and other aspects will become apparent from the following detailed description of the invention when considered in conjunction with the accompanying drawing figures.

DETAILED DESCRIPTION

Figure 1:
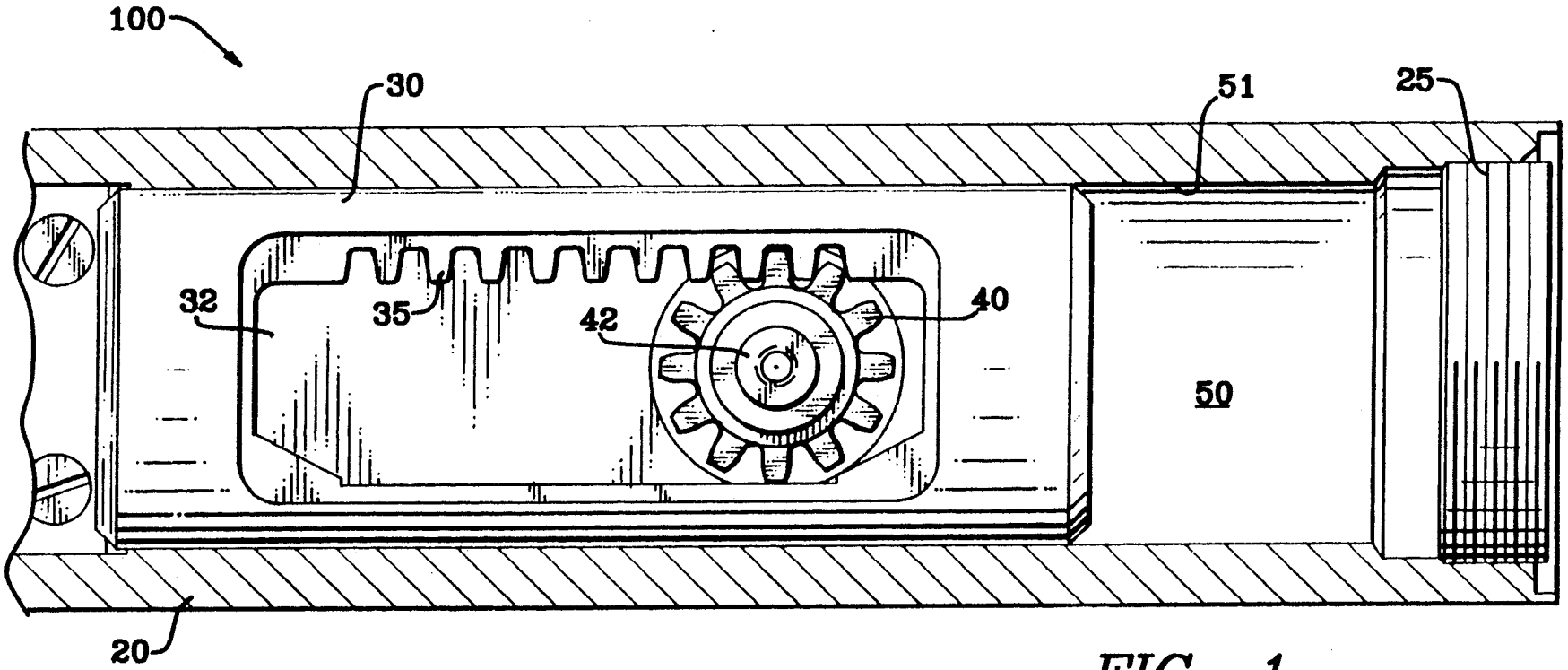
FIG. 1 (PRIOR ART)
FIG. 1 is a fragmentary partially sectional top view of the piston and cylinder arrangement of a typical door closer.

FIG. 1 shows a fragmentary partially sectional view of the piston/cylinder arrangement commonly found in door closers. Closer 100 is made up of cylinder 20 with cylinder head 25 in which piston 30 is reciprocably positioned. The fit between piston 30 and bore 51 is close enough to prevent bypass of fluid from the high pressure portion 50 of cylinder 20 during operation. Within piston 30 is through slot 32 which accommodates pinion gear 40 mounted on shaft 42 which is perpendicular to the axis of piston 30. Gear rack 35 is formed in one lateral wall of slot 32 and is engaged with pinion 40 to couple the movements of piston 30 to those of the closer arm, not shown, when the door is moved.

When the door is opened, pinion 40 drives rack 35 to the left as seen in FIG. 1, and a powerful spring, not shown, is compressed. As the spring force causes the door to close, piston 30 travels rightward so that rack 35 drives pinion 40 in a clockwise direction and piston 30 pressurizes fluid in high pressure portion 50 of cylinder 20. The pressurized fluid in high pressure chamber 50 in front of the piston escapes through metered orifices, not shown, and limits the rate at which the door can close. Because of their tapered flanks, the teeth of rack 35 and pinion 40 cause a separating force between the two members. This forces piston 30 against the side of cylinder 20 at the back side of rack 35.

Figure 2:
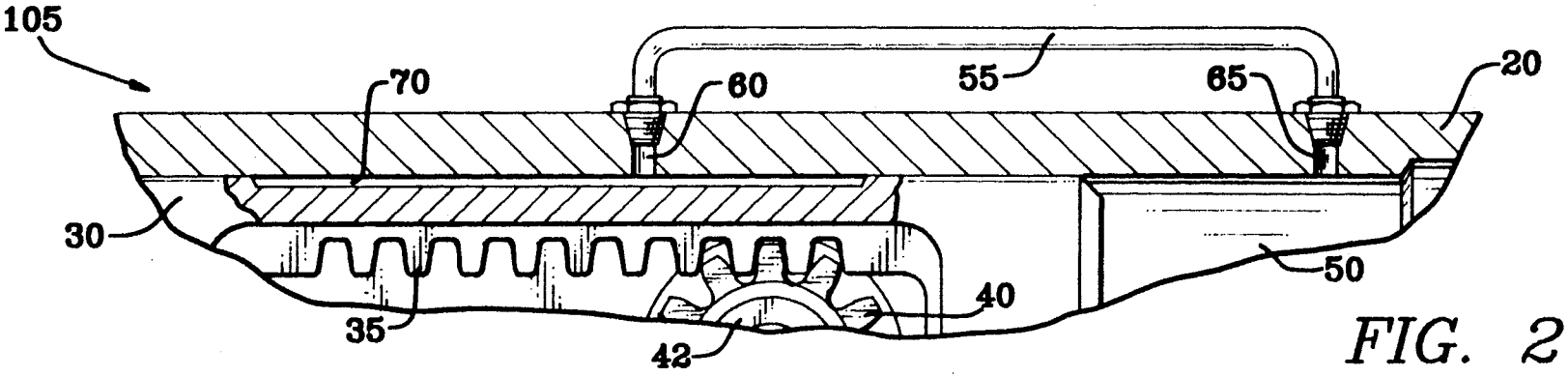
FIG. 2 is a fragmentary view of a door closer as seen in FIG. 1, this time incorporating one embodiment of the present invention.
Figure 3:
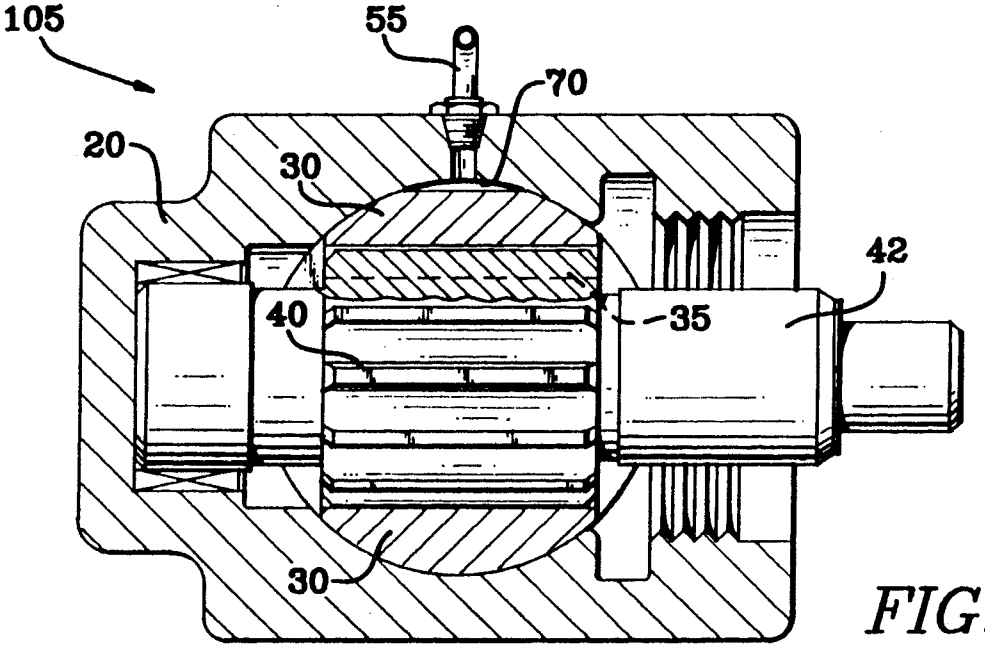
FIG. 3 is a fragmentary partially sectional end view of the closer seen in FIG. 2.

FIGS. 2 and 3 illustrate the essential features of the present invention. Here, closer 105 is made up of all the same components as the common closer illustrated in FIG. 1. In addition, however, the present invention incorporates cavity 70 provided in the lateral surface of piston 30 on the back side of rack 35. In addition, a conduit 55 is provided between fluid ports 60 and 65. In operation, when piston 30 is moving to the right as the door closes, the fluid ahead of piston 30 in chamber 50 is pressurized. The fluid pressure is transferred through port 65 and fluid conduit 55 into cavity 70 through fluid port 60. This transfer of pressure results in equalization of pressure between the chamber 50 and cavity 70. Thus, as the closing rate is increased or decreased, the pressure in chamber 50 increases or decreases correspondingly. The pressure in cavity 70 is increased or decreased and, thus, provides greater or lesser support to the back side of rack 35 to counteract separating forces created by the tapered teeth of rack 35 and pinion 40. In this way, a variable bias is provided to maintain the rack 35 in engagement with pinion 40 and to prevent distortion and sideward displacement of piston 30. This eliminates the normally expected increase of friction between piston 30 and cylinder 20 so that the stored energy of the door closer spring is recovered as door closing energy and is not wasted in overcoming wear producing friction.

Figure 5:
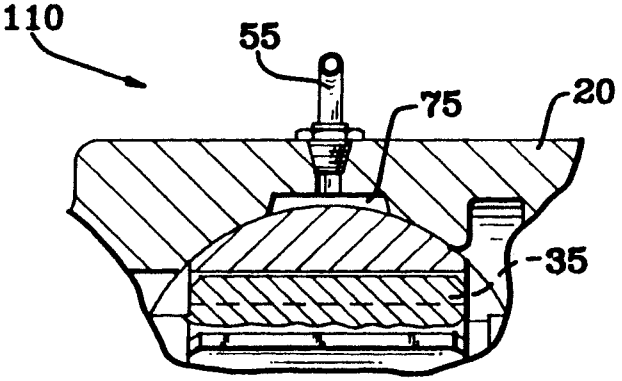
FIG. 5 is a fragmentary partially sectional end view of the closer shown in FIG. 4.
Figure 4:
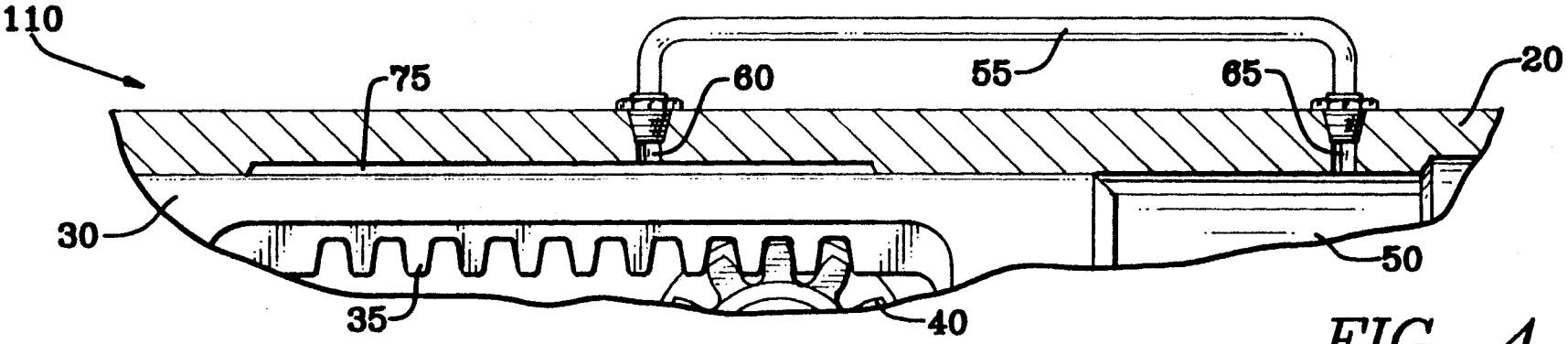
FIG. 4 is a fragmentary partially sectional top view of a door closer incorporating a second embodiment of the present invention.
Figure 6:
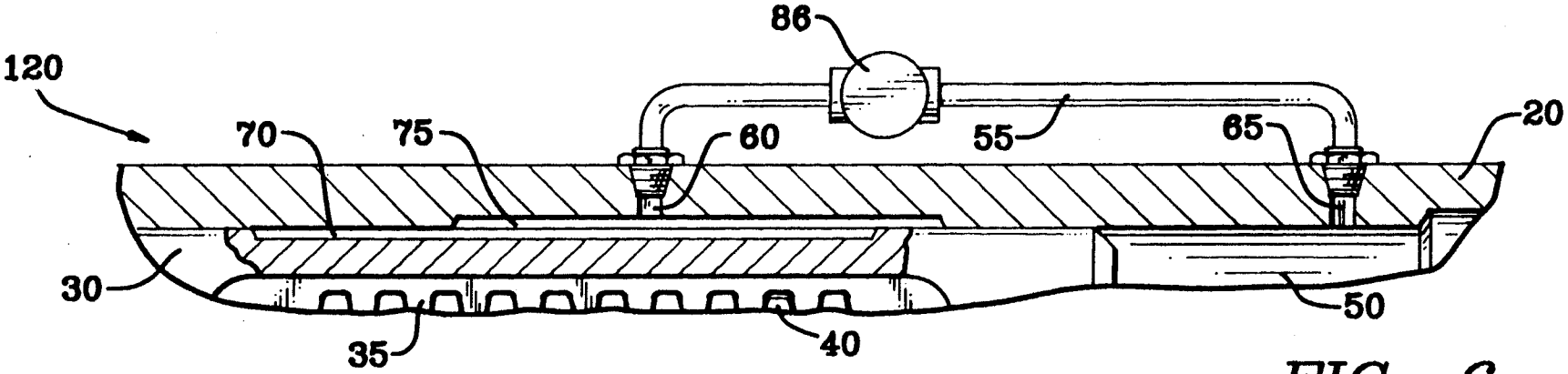
FIG. 6 is another top view of a door closer illustrating a third embodiment of the present invention.

FIGS. 4 and 5 illustrate another embodiment of the invention. Closer 110, in this case, is provided with pressure balancing cavity 75 in the cylinder wall. In all other respects the function of the invention is the same in both embodiments. Also, FIG. 6 presents yet a third embodiment in which closer 120 is configured with a pressure equalization or variable biasing cavity 75 and 70 in both cylinder wall 20 and piston 30, respectively. Finally, valve 86 may be included in fluid pressure transfer conduit 55 to limit or otherwise control the pressure transfer between high pressure chamber 50 and cavities 70 and/or 75.

By providing the variable dynamic feedback of pressure between the high pressure chamber 50 and the appropriate cavity, friction is minimized in the operation of the closer. As a consequence, wear of the rack, the pinion, the cylinder and the piston is minimized and service life is extended. In addition, the efficiency of the closer operation is improved.

It is also possible to provide variable biasing fluid pressure by means of a pump driven by the pinion shaft. This may be coupled with an accumulator for storing fluid pressure to be applied as needed.

What is claimed is:

1. In a door closer which has a piston within a cylinder with a gear rack formed on said piston and a gear pinion engaging said gear rack, said gear pinion being affixed to a shaft whose axis is perpendicular to said piston and said gear rack, the improvement, in combination with said piston, said cylinder, said gear rack, and said gear pinion, comprising:

means for providing a variable biasing force to said gear rack in order to counteract a separating force between said gear rack and said gear pinion.

2. The combination of claim 1, wherein said means for providing a variable biasing force comprises a cavity between the surfaces of the cylinder and the piston, said cavity being behind said gear rack at an intermediate segment of the piston travel within the cylinder; and a fluid conduit means for pressurizing said cavity with fluid from a high pressure source.

3. The combination of claim 2, wherein the high pressure source comprises a high pressure portion of said cylinder in front of said piston.

4. The combination of claim 3, further comprising:

a valve means in said fluid conduit means for regulating pressure transfer from the high pressure portion of said cylinder to said cavity.

5. The combination of claim 2, wherein the high pressure source comprises a fluid pump attached to said pinion shaft.

6. The combination of claim 2, wherein the cavity is formed in an intermediate portion of the lateral outer surface of the piston behind the gear rack.

7. The combination of claim 2, wherein the cavity is formed in the cylinder wall at a location adjacent to the lateral outer surface of the piston behind the gear rack.

8. The combination of claim 2, wherein the cavity is formed in both the cylinder wall and the lateral outer surface of the piston behind the gear rack.

9. In a rack and pinion gear apparatus movable in conjunction with reciprocation of a piston within a fluid containing cylinder, said rack being formed on one longitudinal wall of said piston an said pinion gear being mounted on a shaft perpendicular to and in meshed engagement with said rack, a device, in combination with said rack and pinion gear apparatus, for counteracting a separating force between said rack and said pinion gear, comprising:

means for biasing said rack toward said pinion gear, said bias being proportional to said separating force.

10. The combination of claim 9, wherein the means for biasing said rack comprises a cavity between the surfaces of the cylinder and the piston, said cavity being behind the rack bearing wall of said piston, and a fluid conduit for pressurizing said cavity with fluid from a high pressure portion of said cylinder in front of said piston.

11. A method for biasing a rack toward a pinion in a rack and pinion gear apparatus, having a piston which moves in a fluid containing cylinder in response to movements of said rack, comprising:

providing a fluid containing cavity against a surface of the rack opposite the surface of the rack upon which gear teeth are formed; and providing a conduit means between a high pressure portion of said cylinder and said cavity for equalizing pressure therebetween.

* * * * *